US005556231A

United States Patent [19]

Sidaway et al.

[11] Patent Number: 5,556,231

[45] Date of Patent: Sep. 17, 1996

[54] SEVERABLE LEACHING CHAMBER WITH END CAP

[75] Inventors: H. John Sidaway, McComb; Douglas O. Hamilton, Findlay, both of Ohio

[73] Assignee: Hancor, Inc., Findlay, Ohio

[21] Appl. No.: 299,828

[22] Filed: Sep. 1, 1994

[51] Int. Cl.[6] ..... E02B 13/00

[52] U.S. Cl. ..... 405/48; 405/43; 405/46; 405/49

[58] Field of Search ..... 405/36, 40, 42, 405/43–49; 285/178, 424; 210/532.2

[56] References Cited

U.S. PATENT DOCUMENTS

| | | | |
|---|---|---|---|
| D. 329,684 | 9/1992 | Gray | D23/207 |
| 460,352 | 9/1891 | Reading . | |
| 680,548 | 8/1901 | Sikes . | |
| 980,442 | 1/1911 | Schlafly . | |
| 2,153,789 | 4/1939 | Carswell et al. | 61/13 |
| 2,366,522 | 1/1945 | Gutman | 61/10 |
| 2,782,604 | 2/1957 | Nixon | 405/46 |
| 2,866,319 | 12/1958 | Nicholson | 61/11 |
| 3,333,422 | 8/1967 | Neyland | 61/13 |
| 3,440,823 | 4/1969 | Olsen | 61/11 |
| 3,495,410 | 2/1970 | Bailey et al. | 61/11 |
| 3,570,251 | 3/1971 | Roberts | 61/10 |
| 3,579,995 | 5/1971 | Flynn | 61/13 |
| 3,645,100 | 2/1972 | LaMonica | 61/13 |
| 4,245,924 | 1/1981 | Fouss et al. | 405/45 |
| 4,360,042 | 11/1982 | Fouss et al. | 138/119 |
| 4,523,613 | 6/1985 | Fouss et al. | 138/121 |
| 4,759,661 | 7/1988 | Nichols et al. | 405/48 |
| 5,017,041 | 5/1991 | Nichols | 405/48 |
| 5,087,151 | 2/1992 | Ditullio | 405/49 X |
| 5,156,488 | 10/1992 | Nichols | 405/48 |

OTHER PUBLICATIONS

"Flared End Section" (New Product Announcement), Hancor, Inc. 1992.

"The No Gravel Leaching Field System You Can Haul in One Truck", The Infiltrator Advertisement & Technical Support Paper, Apr. 1987.

*Primary Examiner*—David J. Bagnell
*Assistant Examiner*—Frederick L. Lagman
*Attorney, Agent, or Firm*—Fay, Sharpe, Beall, Fagan, Minnich & McKee

[57] ABSTRACT

A leaching chamber (10) includes first and second side walls (46) which have louver sections. The side walls are connected by vaulted portion (48) to define a chamber potion (12) terminating at a first end (16) and a second end (18). Male and female coupling collars (20, 30) are integrally connected with corrugation peaks at the first and second ends. An intermediate peak or structure (70) has a first portion (72) with a profile of the male coupling collar and a second portion (74) with a profile of the female coupling collar upon cutting between the two portions, two subchambers (12', 12") are formed each having a female coupling collar at one end and a male coupling collar at the other. An inlet end cap (14) is telescopically connected to the female coupling collar (30). The inlet end cap (14) has a sleeve (102) to receive a conduit carrying effluent and a diffuser (104) to diffuse the received effluent. The diffuser includes a sloping surface with diverging ribs (106). A sloping surface (108) extends along a bottom edge of the end cap aligned with the diffuser to absorb the erosion inducing force of fluid falling from the diffuser.

14 Claims, 5 Drawing Sheets

SEVERABLE LEACHING CHAMBER WITH END CAP

BACKGROUND OF THE INVENTION

The present invention pertains to the drainage arts. It finds particular application in leaching fields and will be described with particular reference thereto. However, it is to be appreciated that the present invention will also find application in conjunction with storm water dispersions and other types of drainage systems.

Typically, when leaching fields are utilized for drainage, effluent (a term commonly used for waste materials such as liquid industrial refuse or sewage which flow out of a source and is discharged into the environment) is carried from its source to the leaching field for dispersion, or percolation, into surrounding soil. Pipes that carry the effluent discharge the material into a chamber, or vault. Perforated conduit sections leading from the chamber are usually buried in a trench to facilitate dispersion of the effluent into the soil. In some systems, the chamber is defined by large diameter perforated conduit. In other systems, the chamber is perforated to provide direct dispersion. The effluent is then dispersed into the soil either through the soil serving as the floor of the chamber or, when effluent accumulates in the chamber, through passages in side walls of the chamber.

Prior art leaching conduits are commonly formed of plastic resin material and corrugated for strength. These conduits are formed in sections which are mated to vary the effective length of the leach field. Direct leaching chambers are also connected to increase the length and capacity of the leach field.

It is advantageous not only to be able to increase the length of the chamber by adding sections, but also to be able to provide a chamber of a length which is less than the molded, manufactured section.

Additionally, known direct leaching chambers have complicated pipe inlets which are formed from multiple chamber components, increasing complexity and cost. Moreover, known structures do not provide an effective system for diffusion of the effluent as the effluent is carried into the chamber through the pipe inlet.

Another disadvantage of the conventional leaching systems is that erosion tends to occur where the effluent is drained out of the pipe into the chamber. Typically, a rock, or other hard material, is placed on the soil directly below the pipe inlet to deter erosion.

The present invention contemplates a new and improved leaching chamber which resolves the above-referenced difficulties and others.

SUMMARY OF THE INVENTION

A leaching chamber for receiving effluent is provided. The chamber is comprised of first and second walls having louvers grouped in sections and radially offset from one another disposed therein to allow effluent to pass therethrough. A vaulted portion spans the distance between the first and second walls to define a chamber.

In accordance with one aspect of the present invention, an intermediate support structure, or peak portion, is provided to the chamber and is selectively separable.

In accordance with a more limited aspect of the present invention, the intermediate support structure includes a first portion which mimics a first end of the chamber and a second portion which mimics a second end of the chamber so that, upon separation, identical subchambers are formed.

In accordance with another aspect of the present invention, an end cap is provided which is removably connected to the first end. The end cap has a conduit inlet aperture and a lip or diffuser connected to the end cap to diffuse effluent discharged from the conduit.

In accordance with a more limited aspect of the invention, the end cap further includes an angled portion extending along a bottom edge and substantially aligned with the lip to deflect the effluent after being diffused by the lip.

In accordance with a more limited aspect of the invention, the inlet aperture is generally circular and the lip includes channels defined by flanges or ribs.

One advantage of the present invention is that identical subchambers can be formed from a single integrally molded chamber to increase flexibility and adaptability thereof.

Another advantage of the present invention is that effluent carried into the chamber is diffused by the diffuser disposed in the end cap to inhibit erosion of the underlying soil.

Another advantage of the present invention is that erosion of soil beneath the pipe inlet is further reduced by a deflector portion of the end cap.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
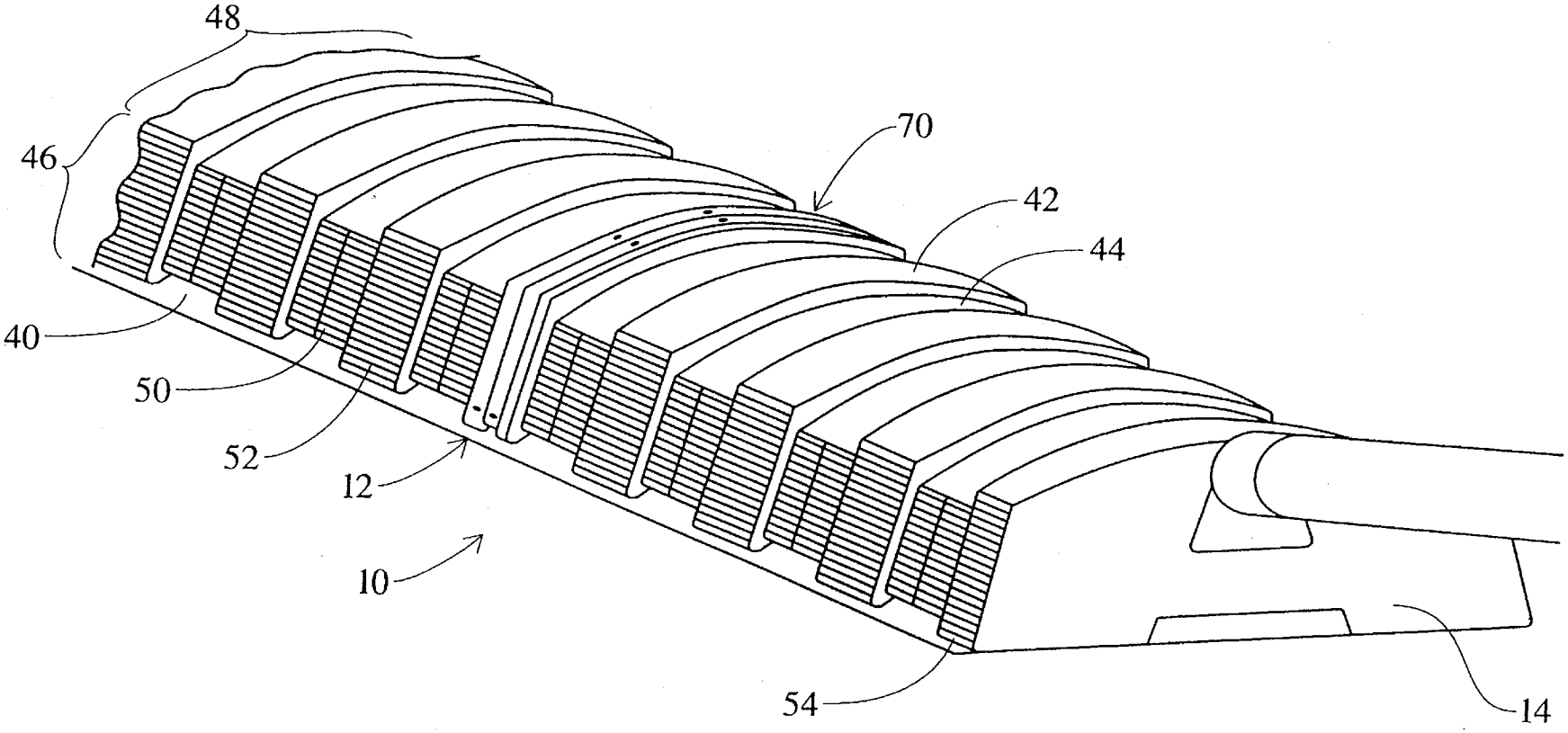
FIG. 1 is a perspective view of a leaching chamber in accordance with the present invention.

With reference to FIG. 1, a molded, polyethylene leaching chamber 10 includes chamber or vault portion 12, an inlet end cap 14, and a closed end cap (not shown). The end caps are releasably mounted at opposite ends of the chamber portion 12. The chamber portion 12 may also be matingly connected with additional chamber portions to increase the length of the leaching chamber 10 as a whole. The leaching chamber 10 is particularly suited to be positioned in a drainage trench with its open end down, creating a vault or chamber for drainage. An inlet conduit which supplies effluent is received in the inlet end cap. Soil or gravel is placed on top of the chamber 10 so that the chamber will ultimately not be seen from ground level.

Figure 2:
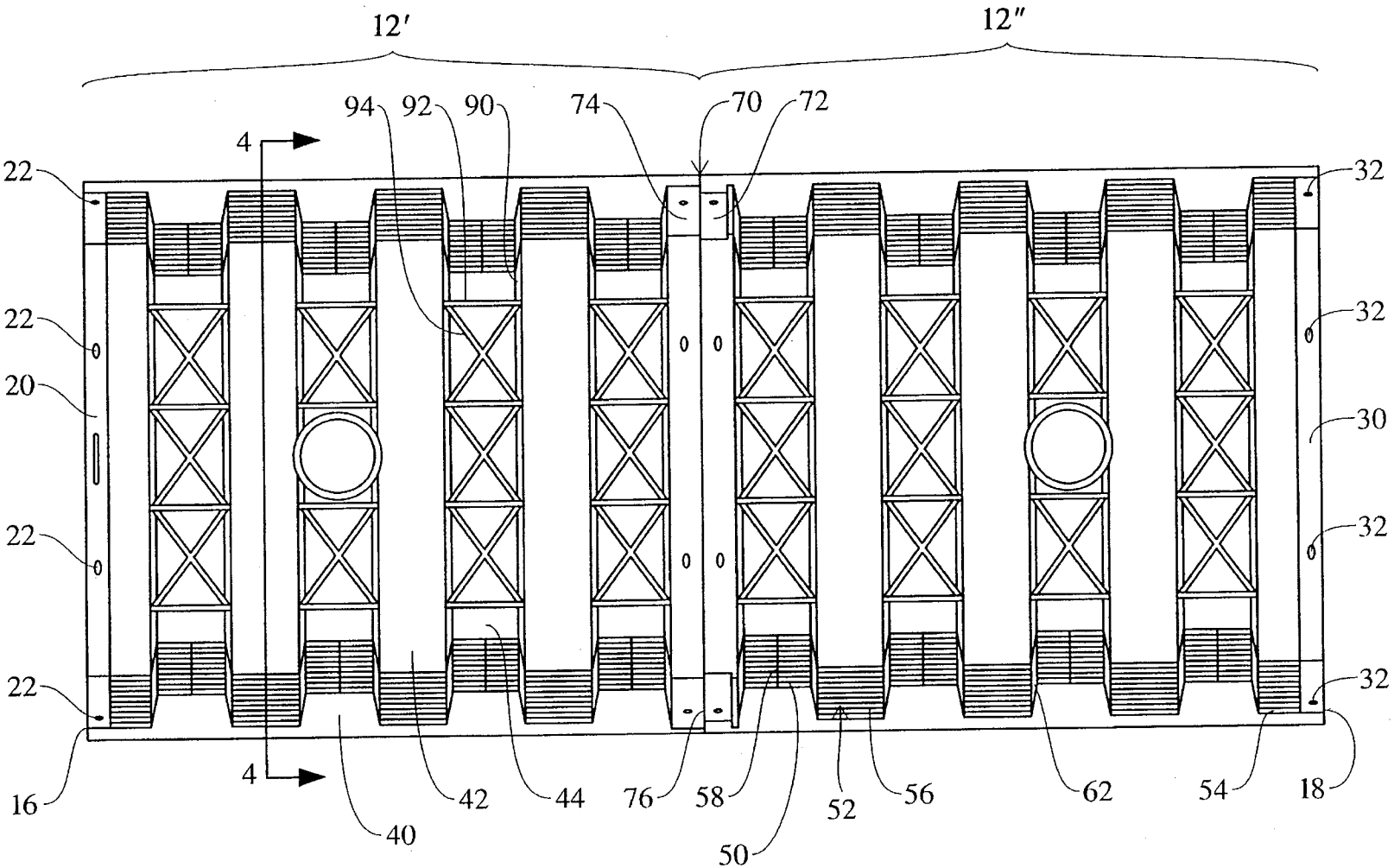
FIG. 2 is a top view of the chamber portion of the leaching chamber of FIG. 1.
Figure 3:
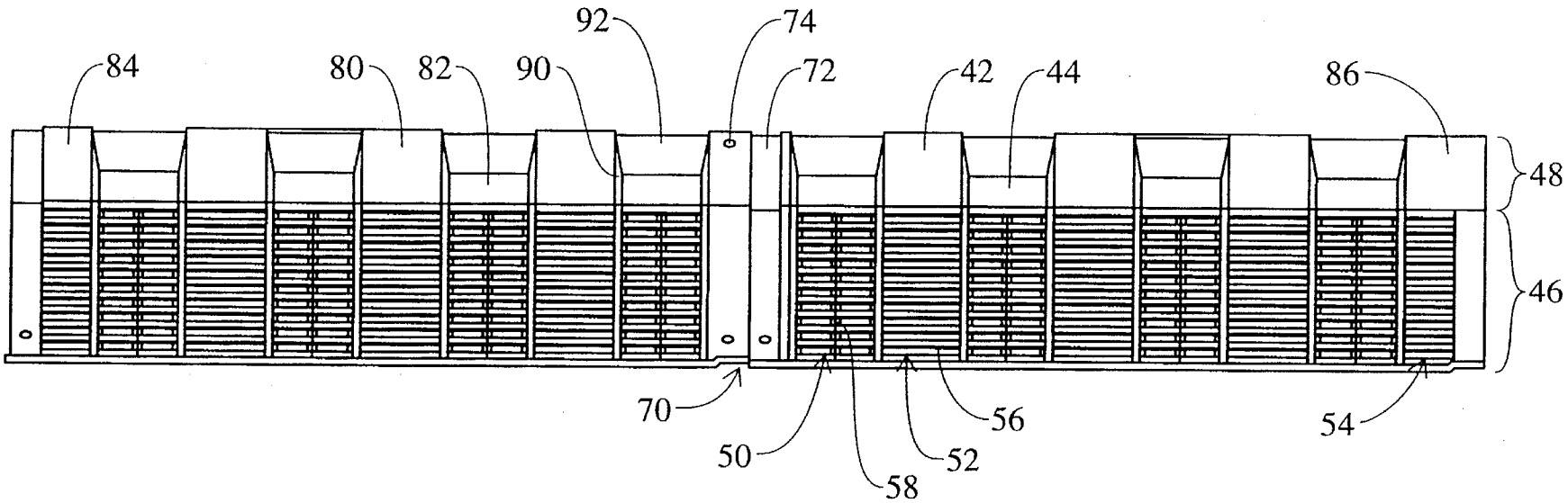
FIG. 3 is a side view of the chamber portion of the leaching chamber of FIG. 1.

Referring now more particularly to FIGS. 2 and 3, the chamber portion 12 includes a first end 16 and a second end 18. The first end 16 includes a first end male coupling collar 20 which is circumferentially disposed about the first end 16 to conform generally with the cross-sectional shape (FIG. 4) of the chamber portion 12. The first end collar 20 has knob-like protrusions 22 disposed thereon. The protrusions facilitate mating assembly with either the inlet end cap 14 or the opposite end of an additional chamber portion. The second end 18 includes second end female coupling collar 30 which has apertures or protrusions 32 which matingly engage corresponding protrusions 22 on an additional chamber portion or the closed end cap. Like first end collar 20, second end collar 30 is circumferentially disposed around second end 18 to generally conform to the cross sectional shape (FIGURE 4) of the chamber The arrangement of protrusions and apertures on the first end, second end, and the end caps is, of course, adaptable. For example, apertures are alternatively placed on the first end and protrusions on the second end and the end cap. Further, the protrusions may be placed on the inside or outside surface of the respective component and the apertures may be through-holes or simply suitably sized indentations. Moreover, apertures (or protrusions) may be placed on both the first and second ends so long as a corresponding chamber portion 12 includes protrusions (or apertures) on both ends for mating. Other mechanical interconnection mechanisms, both integrally molded and separately attached, are also contemplated.

The chamber portion 12 includes base surfaces or foot portions 40. Corrugations having alternating peak portions 42 and valley portions 44 extend between the foot portions. The peaks and valleys have lower, side walls 46 extending linearly upward from the foot portions 40 toward an apex area. A corrugated top wall or vault 48 connects opposite side walls 46.

The side walls 46 comprise inner louver sections 50, outer louver sections 52, and end louver sections 54. Each louver section includes a plurality of louvers 56 defining dispersion apertures and disposed parallel to one another and suitably spaced and angled to allow drainage in one direction yet inhibit an influx of soil or gravel in the other direction.

The inner louver sections 50 further include support rails 58, to enhance rigidity of the chamber portion 12. The end louver sections 54 are similar to the other louver sections except that they are approximately one-half (½) the length of the other louver sections. The end louver sections are disposed on half of end peaks adjacent the end collars 20, 30 to facilitate mating with respective end caps or other chambers.

Figure 4:
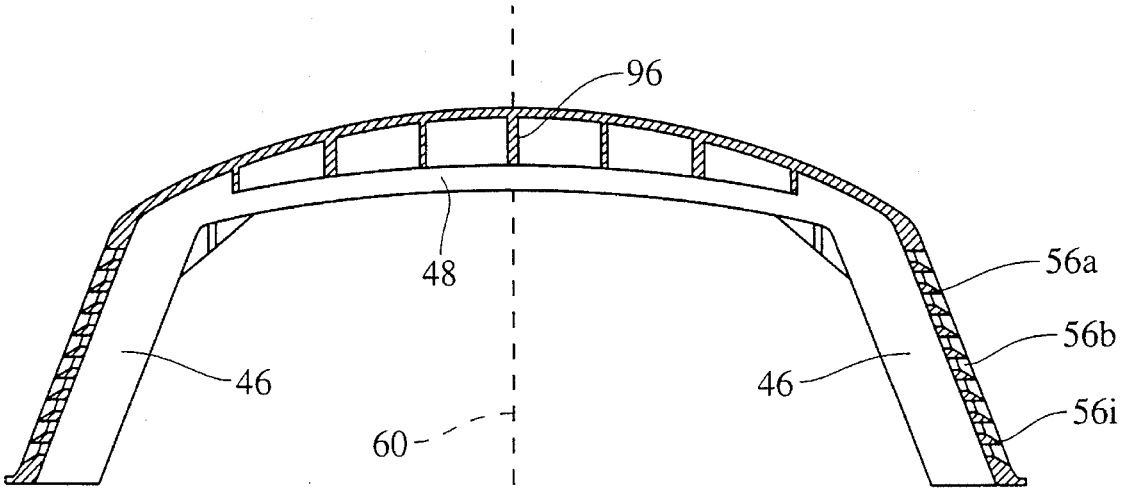
FIG. 4 is an enlarged cross sectional view along line 4—4 of FIG. 2.

The louver sections allow effluent to pass from the inside of the chamber portion 12 to the outside of the chamber portion 12 to be absorbed in surrounding soil. Accordingly, as shown in FIG. 4, each louver section is disposed on an angle with respect to a central vertical axis 60 of the chamber 10. When the chamber 10 is installed in a drainage trench, the top louvers of each section are a smaller distance from the vertical axis than the bottom louvers. For example, louver **56*a* is a smaller distance from vertical axis than louver 56*i*. This arrangement allows for drainage of the effluent out of the chamber portion 12 and inhibits influx of soil or gravel into the chamber portion 12. As those skilled in the art will appreciate, effluent flowing over the upper most louver 56*a* will pass over the end of upper most louver 56*a* on to the top surface of the next louver 56*b*** therebelow and eventually drain into the soil.

As illustrated in FIGS. 2 and 3, the louver sections are generally rectangular and disposed parallel to one another but are alternatingly offset from one another. The arrangement is such that each louver section is offset from each adjacent louver section thereto by a set distance. Vertical connecting webs or corrugation edge walls 62 are provided to connect adjacent louver sections. The connecting webs converge inward from the peaks to the valleys.

A central, or intermediate, corrugation peak, or support structure, 70 includes a first portion 72 which is substantially identical to the first end collar 20 and a second portion 74 that is substantially identical to the second end collar 30.

The central corrugation peak 70 not only provides support for the chamber 12, but also provides a mechanism for separating the chamber 12 into two identical components or subchambers 12' and 12". The integrally formed first and second portions 72, 74 are cut through center line 76. Once separation is accomplished, the two identical sub-chamber portions 12' and 12" are formed. The first sub-chamber portion 12' includes a first or male collar 20 at the first end 16 and a second or female coupling collar 74 at the other end 74. The second sub-chamber portion 12" includes the female coupling collar 30 at the second end 18 and the male or first coupling collar 72 at the other end. As can be seen, each sub-chamber is merely a smaller version of the chamber portion 12. Alternately, an increased number of intermediate peaks 70 may be disposed throughout the chamber portion 12 to facilitate separation of the chamber 10 into an increased number of subchambers.

With reference to FIG. 4, the side walls 46 are connected by vaulted portion 48 to form the vault or chamber. As shown in FIG. 3, the vaulted portion 48 includes vault peak 80 and valley portions 82. End peak portions 84 and 86 are only one-half (½) the size of the others. The vault peak portions align with the outer louver sections 52 which do not include supporting rails, as shown in FIGS. 2 and 3, and the vault valley portions align with the inner louver sections 50 having the supporting rails. In this arrangement, a combination of the staggered side walls, having louver sections and the corrugated vaulted portion provides a corrugated support structure for the chamber portion 12. As can be seen in FIGS. 2 and 3, the corrugation includes alternating support structures wherein the support structures of the raised portions have a greater cross-sectional area than the support structures of the lower portions.

The first and second connection collars 20, 30 are disposed on the peak portions, not the valley portions. The first or male collar is offset from the peak portion by the thickness of the plastic in the collar portions. The second or female collar is flush with the peak portion. This arrangement has advantages in that a maximum measurable volume of the chamber 10 is obtained, as will be described in greater detail below.

With reference to FIGS. 2 and 3, the peak portions 82 of the vaulted portion have edge walls 90. Longitudinal ribs 92 extend between the peak edge walls 90 to inhibit longitudinal distortion. Crossed ribs 94 inhibit twisting. While this specific webbing configuration (not completely shown in FIG. 1) is shown in FIGS. 2 and 3, other suitable alternative configurations which provide like support are recognized as falling within the spirit and scope of the invention. Additional ribs 96 (FIG. 4) are integrally molded under the vault peak portions.

Figure 5:
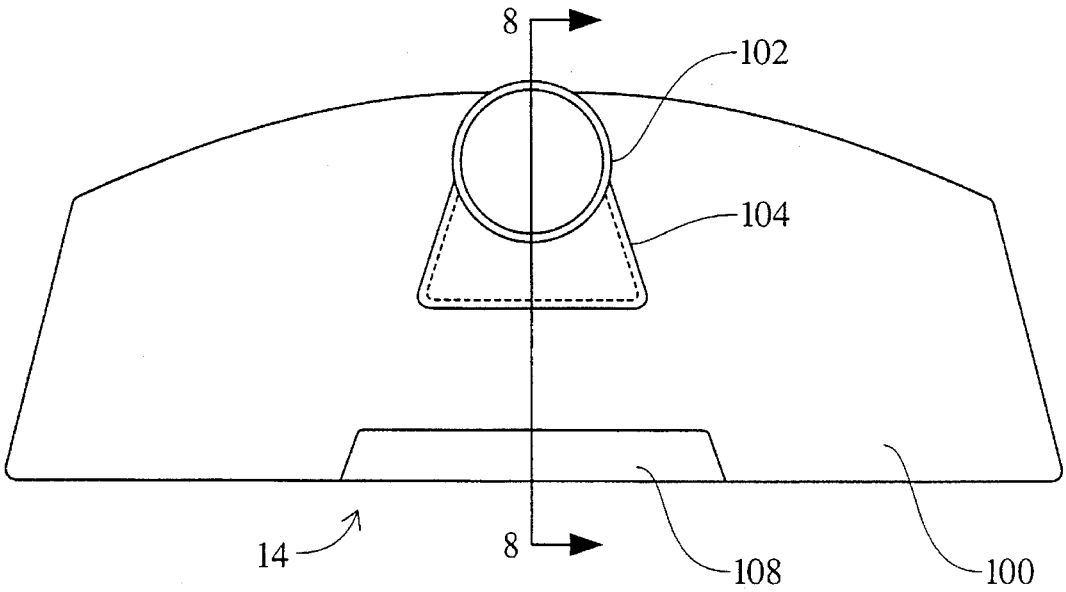
FIG. 5 is an enlarged front view of an end cap of the leaching chamber of FIG. 1.

Referring now to FIG. 5, the end cap 14 includes a panel 100 from which a cylindrical inlet sleeve 102 extends. The inlet sleeve 102 is positioned at the top of the panel 100 to have a maximum measurable volume below the inlet in the chamber 10. Volume is typically measured from the bottom of the inlet to the bottom of the chamber 10 along the length of the chamber 10. If volume is not a concern, then the pipe inlet is alternatively positioned anywhere on the end cap. Similarly, a folded portion, or angled baffled surface 108 is shown at the bottom edge of the panel 100.

Figure 6:
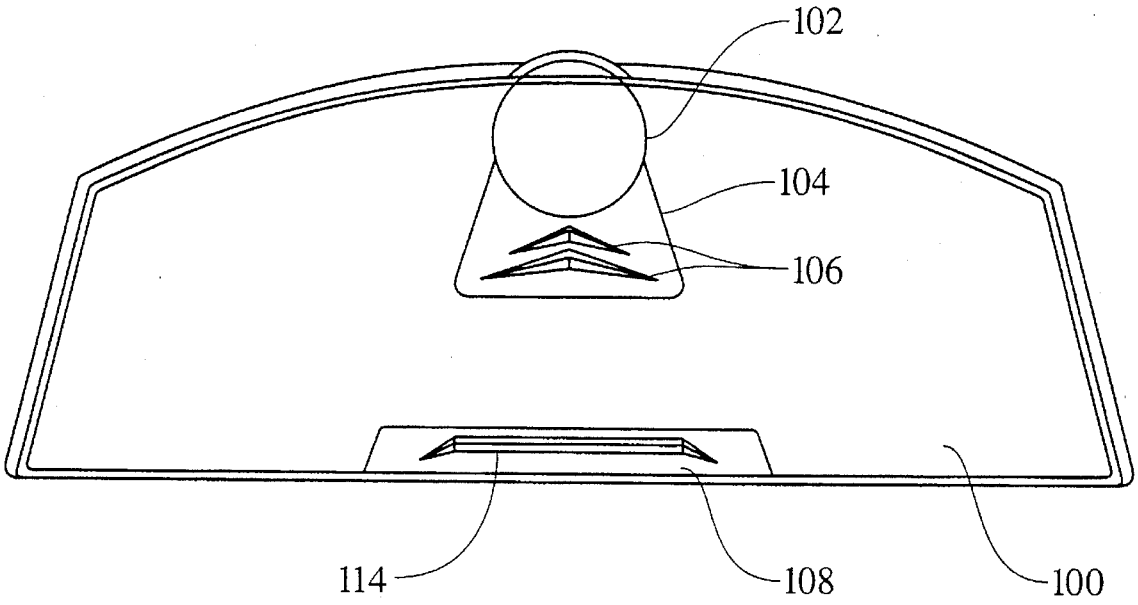
FIG. 6 is an enlarged back view of the end cap of FIG. 5.
Figure 7:
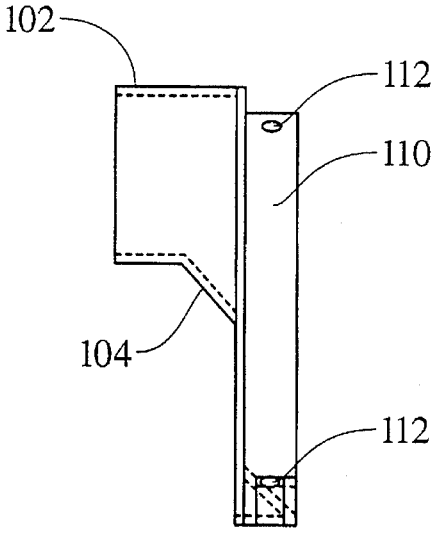
FIG. 7 is an enlarged side view of the end cap of FIG. 5.
Figure 8:
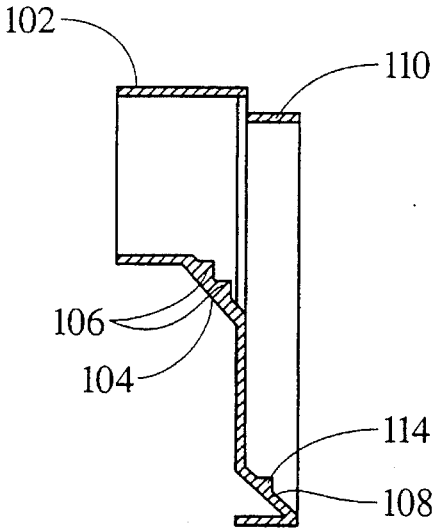
FIG. 8 is an enlarged cross sectional view along line 8—8 of FIG. 5.

With continuing reference to FIG. 5 and further reference to FIGS. 6, 7, and 8, a diffuser 104 slopes downward from the inlet and flares outward. Ribs or flanges 106 define diverging diffusion channels to facilitate diffusion of effluent as it enters the chamber 10. The angled baffle surface 108, disposed at a bottom edge of panel 100 and vertically aligned with the diffuser 104, absorbs the energy of fluids falling from the diffuser and causes further diffusion. The angled, or sloping surface 108 inhibits erosion of the soil directly underneath the inlet. A rib or flange 114 is optionally provided to the surface 108 to further facilitate diffusion.

The inlet cap 14 has end cap coupling collar 110 which mates telescopically in the second or female coupling collar 30. Apertures or recesses 112 are disposed around the collar to receive the protrusions or detents 32. Accordingly, the inlet end cap is conveniently snap-fit into place upon assembly. The closed end cap is configured analogous to the inlet end cap, but without the effluent conduit receiving sleeve 102.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A chamber for receiving fluids to be dispersed, the chamber comprising:

separated side walls, each side wall having louvers defined therein to allow the fluid to be dispersed therethrough;

vaulted portions spanning upper edges of the side walls, the vaulted portions and the side walls terminating at a first end including a first coupling construction and at a second end including a second coupling construction; and an inlet end cap connected with the first end coupling construction, the inlet end cap including:

an inlet for receiving a fluid conveying conduit;

a diffuser contiguous to the inlet for diffusing received fluid.

2. The chamber as set forth in claim 1 wherein the inlet end cap further includes an angled surface extending along a bottom edge and substantially aligned with and below the diffuser to deflect the received fluid.

3. The chamber as set forth in claim 2 wherein the angled surface includes a second rib.

4. The chamber as set forth in claim 1 wherein the diffuser includes a sloping surface and of at least one first rib which diverges from the inlet.

5. The chamber as set forth in claim 1 wherein the first coupling construction includes a first male arch and the second coupling construction includes a first female arch, the female arch defining an inner cross section which is larger than an outer dimension of the male arch such that the male arch is telescopically receivable within the female arch and further including:

an integrally connected second male arch and second female arch, the second male arch having the same outer dimension as the first male arch and the second female arch having the same inner cross section as the first female arch, the integrally connected second male and female coupling arches being integrally connected with the side walls and the vaulted portions midway between the first and second ends.

6. A dispersion chamber for subterranean dispersion of fluids, the chamber comprising:

separated side walls, each side wall having dispersion apertures defined therein to allow the fluid to pass therethrough;

a vaulted portion extending between the side walls to define a chamber terminating at first and second ends;

a first coupling collar integrally connected to the side walls and the vaulted portion at the first end;

an inlet end cap selectively connected with the first end collar, the end cap having an inlet for receiving the fluid to be dispersed and a diffuser below the inlet to diffuse the received fluid into an interior of the chamber.

7. The chamber as set forth in claim 6 wherein the side walls include sections of integral louvers generally between which the apertures are defined, adjacent louver sections being offset from one another and connected by generally parallel webs.

8. The chamber as set forth in claim 6 wherein the inlet end cap further includes an inwardly projecting surface extending along a bottom edge and substantially vertically aligned with the diffuser to deflect the fluid after falling from the diffuser.

9. The chamber as set forth in claim 6 wherein a cylindrical sleeve surrounds the inlet and the diffuser includes a sloping surface extending inward from the inlet and a plurality of ribs projecting upward from the sloping surface and diverging from the inlet.

10. The chamber as set forth in claim 9 further including a second coupling collar integrally connected to the side walls and the vaulted portion at the second end, the first and second coupling collars having first and second profiles that are telescopically receivable, such that a plurality of the chambers are couplable end to end.

11. The chamber as set forth in claim 10 wherein the side walls and the vaulted portion include an integral intermediate section having a first portion with the profile of the first coupling collar and a second portion with the profile of the second collar, the first and second portions being integrally formed with a cutable plastic material such that upon cutting between the first and second portions two subchambers are formed, each subchamber having a coupling collar with the first profile at one end and a coupling collar with the second profile at the other end.

12. A chamber for subterranean dispersion of fluids, the chamber comprising:

a chamber portion having an open base and a plurality of alternating integral peaks and valleys which define a corrugated upper vaulted portion, the upper vaulted portion having a peak at a first end thereof;

a first coupling collar integrally connected with the peak at the first end;

an inlet end cap telescopically received with the first coupling collar, the inlet end cap including:

a sleeve for receiving a fluid conveying conduit, the sleeve defining an inlet aperture therein;

a downward sloping surface disposed on an inner side of the inlet end cap directly below the inlet such that received fluids flow onto the sloping surface.

13. The chamber as set forth in claim 12 further including ribs projecting upward from the sloping surface, the ribs diverging away from the inlet.

14. The chamber as set forth in claim 12 wherein the sloping surface is disposed contiguous to a bottom edge of the inlet end cap to absorb energy from water falling from the inlet.

* * * * *